United States Patent [19]

Finlayson

[11] Patent Number: 4,972,678

[45] Date of Patent: Nov. 27, 1990

[54] REFRIGERATION AND HEAT EXCHANGE SYSTEM AND PROCESS

[76] Inventor: Donald F. Finlayson, 11 Kittyhawk Dr., Pittsford, N.Y. 14534

[21] Appl. No.: 440,774

[22] Filed: Nov. 24, 1989

[51] Int. Cl.[5] ..... F25B 1/00

[52] U.S. Cl. ..... 62/116; 62/196.4; 62/500; 62/512

[58] Field of Search ..... 62/116, 196.4, 500, 62/512

[56] References Cited

U.S. PATENT DOCUMENTS

| | | | |
|---|---|---|---|
| 1,853,724 | 4/1932 | Davenport | 62/512 |
| 3,277,659 | 10/1966 | Sylvan et al. | 62/512 |
| 3,300,995 | 1/1967 | McGrath | 62/500 |
| 3,389,576 | 6/1968 | Mauer | 62/196.4 |
| 3,636,723 | 1/1972 | Kramer | 62/197 |
| 4,045,975 | 9/1977 | McCarty | 62/196.4 |
| 4,068,494 | 1/1978 | Kramer | 62/196.4 |
| 4,341,086 | 7/1982 | Ishii | 62/512 |

*Primary Examiner*—Ronald C. Capossela
*Attorney, Agent, or Firm*—Robert J. Bird

[57] ABSTRACT

A refrigeration system and cycle are disclosed. The system includes a compressor, condenser, injector nozzle, evaporator, and refrigerant separator tank connected in series in a primary refrigerant path. The compressor overfeeds the condenser with refrigerant which therefore condenses only partially to a wet vapor in the condenser. The injector nozzle completes condensation, drawing liquid refrigerant from the separator tank to inject it into the evaporator. The evaporator is a shell and tube heat exchanger, the tubes being product fluid conduits. The shell side of the evaporator is overfed with liquid refrigerant so that most of it does not evaporate. A liquid/vapor refrigerant emulsion is thus produced, maintaining a constant phase transition temperature in the evaporator. The high flow rate of this emulsion within the evaporator creates a turbulence preventing boundary layers from forming on heat exchange surfaces. The separator receives refrigerant from the evaporator, separates liquid from vapor, and feeds the injector nozzle with liquid and the compressor with vapor. A secondary refrigerant line from the compressor outlet to the injector nozzle outlet bypasses the condenser and the injector nozzle. A shut off valve opens this line to admit heat to the evaporator when product temperature reaches a preestablished lower limit, and closes when product temperature reaches a preestablished upper limit.

9 Claims, 1 Drawing Sheet

REFRIGERATION AND HEAT EXCHANGE SYSTEM AND PROCESS

BACKGROUND OF THE INVENTION

1. Field of the Invention

This invention relates generally to refrigeration and heat exchange. More specifically, it relates to a refrigeration and heat exchange system and process for cooling a fluid product in a stream process, and to improved heat exchange in such a system.

2. Background Information

Numerous products of a fluid nature, including a wide variety of food products, are processed and produced in stream processes at temperatures higher than the desired temperature at which the product is to be packed, bottled, canned, or the like. The product must therefore be cooled to the desired temperature in order to insure its proper packing. Many fluid food products, including relatively viscous liquids (e.g. mustard, ketchup, syrup) and free flowing liquids (e.g. beer, milk, vinegar) are processed in this way.

In further describing this background, and the invention itself, it will be helpful to use a specific application of the invention to illustrate the discussion. Dairy processing of milk is a good example for this purpose.

A typical dairy system includes a raw milk storage tank, pasteurizer, homogenizer, cooler, and container filler, all connected in series for continuous stream processing. After leaving the storage tank, the milk is pasteurized at an elevated temperature, cooled in the cooler to 40° F. or below, then dispensed into containers of various sizes at a temperature close to the cooler-exit temperature. In typical current systems the temperature of milk in containers immediately after filling is approximately 42° F. to 44° F. in half gallon containers, and approximately 52° F. to 54° F. in half pint containers. Filling and closure of the containers requires application of heat. The combination of this added heat and the different milk quantities in the different size containers accounts for the substantial differences in milk temperatures in the larger and smaller containers.

It is desirable to fill, store, and deliver milk at as low a temperature, without freezing, as possible. It is an object of this invention to attain product temperatures substantially lower than has been attainable in the prior art. In the case of milk processing, the present invention reduces final product temperatures from the figures given above to approximately 34° F. in half gallon containers and approximately 39° F. in half pint containers.

U.S. Pat. Nos. 1,853,724 to Davenport, and 3,636,723 to Kramer are somewhat relevant prior art. Davenport discloses a refrigeration system including compressor, condenser, injector nozzle, evaporator, and separator, all connected in series. The heat transfer medium in Davenport is an emulsion of refrigerant and air or other non-condensible gas, this for a particular purpose not relevant here. Kramer discloses a refrigeration system which includes a defrosting line 36, by-passing the condenser 31 and expansion valve 33, to inject heat directly into the evaporator 30 for defrosting the evaporator.

Another aspect of this invention relates to heat exchange. In a heat exchanger, a first fluid medium gives up heat to a second fluid medium through a thermally conductive barrier which separates the two media. If the heat exchange media are liquids, and if they move relative to the barrier in a laminar flow condition, the boundary layer of each liquid near the barrier surface is at or near zero velocity and the temperature of that layer is at or near the temperature of the barrier. Successive layers or "lamina" are at respective incremental temperature differences relative to the barrier temperature. These thermal gradients on each side of the barrier offer considerable resistance to heat transfer from one medium to the other. The lamina and their resulting thermal gradients and resistance to heat transfer become especially significant if one or both of the heat exchange media are viscous fluids. Generally, the way to remove or reduce this resistance is to continually remove and replace the boundary layers with fluid from the "main stream".

In process systems of the prior art, the fluid product is typically conveyed through a wiped film heat exchanger. The boundary layer of product fluid is removed, and heat exchange aided, by continual wiping of the product fluid from the heat exchange surface by a wiping blade. Such mechanical wiping apparatus is in intimate contact with the product fluid and must be cleaned periodically, usually by a more or less complex and costly disassembly of the apparatus and replacement of parts.

SUMMARY OF THE INVENTION

In summary, this invention is a refrigeration system and cycle, including a compressor, condenser, injector nozzle, evaporator, and refrigerant separator tank connected in series in a primary refrigerant path. The compressor overfeeds the condenser with refrigerant which therefore condenses only partially to a wet vapor in the condenser. The injector nozzle completes condensation, drawing liquid refrigerant from the separator tank to inject it into the evaporator. The evaporator is a shell and tube heat exchanger, the tubes being product fluid conduits. The shell side of the evaporator is overfed with liquid refrigerant so that most of it does not evaporate. A liquid/vapor refrigerant emulsion is thus produced, maintaining a constant phase transition temperature in the evaporator. The high flow rate of this emulsion within the evaporator creates a turbulence preventing boundary layers from forming on heat exchange surfaces. The separator receives refrigerant from the evaporator, separates liquid from vapor, and feeds the injector nozzle with liquid and the compressor with vapor.

A secondary refrigerant line from downstream of the compressor to downstream of the injector nozzle bypasses the condenser and the injector nozzle. A shut off valve opens this line to admit heat to the evaporator when product temperature reaches a preestablished lower limit, and closes when product temperature reaches a preestablished upper limit.

DESCRIPTION OF THE PREFERRED EMBODIMENT

Figure 1:
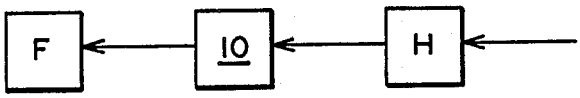
FIG. 1 is a schematic diagram of part of a milk processing system showing an environment for the system and process of this invention.

The dairy system schematically represented in FIG. 1 includes a milk homogenizer H, the refrigeration and heat exchange system 10 (sometimes hereinafter simply a "refrigeration system") of this invention, and a container filler apparatus F, all in series for continuous stream processing. Milk flows right to left from upstream stations, such as a storage tank and pasteurizer (not shown), into the homogenizer H, the refrigeration system 10, and finally to the filler apparatus F for packaging.

A liquid evaporating to vapor absorbs heat. Conversely, a vapor condensing to liquid gives up heat. Mechanical refrigeration is accomplished in a thermodynamic cycle of a refrigerant which is alternately vaporized to absorb heat from a "cold" chamber (the chamber to be refrigerated), and condensed to release this heat to the surroundings. The classical prior art refrigeration cycle includes the following steps, in repetitive sequence:

(1) Compression—Refrigerant vapor is compressed and thereby heated to a temperature above that of the surrounding heat sink;

(2) Condensation—The hot compressed vapor passes through condenser coils, external of the cold chamber, giving up its latent heat of vaporization to the surrounding heat sink and condensing to liquid;

(3) Throttling—The condensed liquid, still under pressure, passes through a throttling valve or nozzle, emerging as low pressure liquid; and (4) Evaporation—The low pressure liquid absorbs its heat of vaporization and evaporates in coils in the cold chamber which are thereby cooled below the temperature of the heat sink. Evaporation is complete, and the evaporated refrigerant therefore also absorbs sensible heat which increases its temperature above the evaporation temperature.

Figure 2:
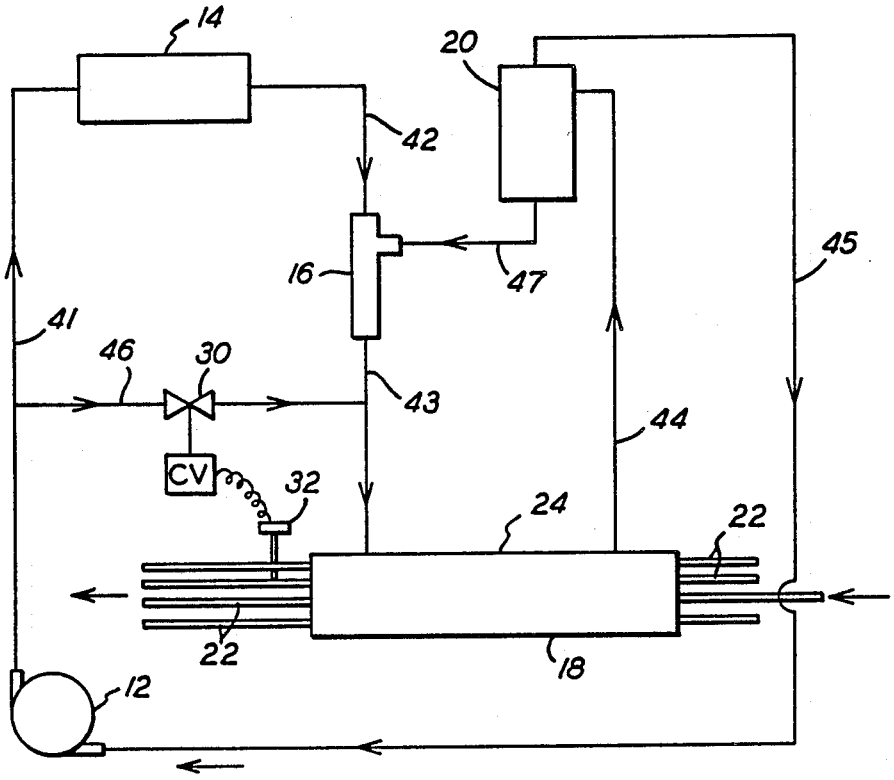
FIG. 2 is a schematic diagram of a refrigeration and heat exchange system and process according to this invention.

The refrigeration system 10 of this invention is shown schematically in FIG. 2. It includes a compressor 12, condenser 14, injector nozzle 16, and evaporator 18, and a refrigerant separator tank 20, all operatively connected in a refrigerant loop. The primary refrigerant loop connecting these elements includes a high pressure (HP) vapor line 41 from the compressor 12 to the condenser 14; a high pressure (HP) line 42 from the condenser 14 to the pressure port of the injector nozzle 16; a low pressure (LP) liquid line 43 from the discharge port of nozzle 16 to the evaporator 18; a low pressure (LP) line 44 from the evaporator 18 to the vapor side of separator 20; and a low pressure (LP) vapor line 45 from the separator 20 to the inlet of compressor 12. This is the primary flow path. A secondary high pressure (HP) vapor line 46 connects the primary HP line 41 to the LP liquid line 43, by-passing the condenser 14 and the injector nozzle 16. LP liquid line 47 connects the liquid side of separator 20 to the suction port of nozzle 16.

The system may include additional elements, such as a heat recovery water heater and an oil separator. Such components are well known and are not included here because they are not essential to an understanding of the present invention.

The evaporator 18 is a single-pass shell and tube heat exchanger, including a plurality of parallel tubes 22 extending through a shell 24 and supported by enclosing tube sheets (not shown) at each end. The shell side of the evaporator 18 is the refrigerant side. Evaporator tubes 22 are product conduits, entering the evaporator at one end and leaving at the other end. It is one aspect of this invention that product flow may be in either direction through the evaporator without affecting its heat exchange characteristics. For the sake of illustration, however, consider the product as flowing from right to left through the evaporator, as indicated by the arrows.

The refrigeration cycle in system 10 is as follows:

(1) Compression—Compressor 12 discharges refrigerant vapor at high pressure in HP vapor line 41 to the condenser 14. The condenser is overfed with compressed refrigerant, unlike the prior art cycle.

(2) Condensation—Condensation in the condenser is only partial because the condenser is overfed. Refrigerant leaves the condenser in HP line 42 as wet vapor, still under pressure, for the injector nozzle. Condensation is completed in the injector nozzle 16. Energy given up by the refrigerant in the injector nozzle, which would otherwise be wasted at the condenser to the surroundings, is used to pump liquid refrigerant into the evaporator.

(3) Throttling—Injector nozzle 16 discharges lower pressure and temperature liquid refrigerant, including liquid drawn from the separator 20, into LP liquid line 43 and injects it into the evaporator 18. Energy given up by the refrigerant to effect this pumping action completes the condensation of refrigerant from the condenser.

(4) Evaporation—Only a small proportion of the liquid refrigerant is evaporated in the evaporator 18. The resulting low pressure mixture of vapor and liquid, which is in the nature of a liquid/vapor emulsion, leaves the evaporator through LP line 44 to the separator tank 20 which separates liquid and vapor by gravity. The vapor proceeds from the tank 20 through LP vapor line 45 to the inlet of the compressor 12. The liquid is drawn from the tank 20 through LP liquid line 47 to the suction side of the injector nozzle 16. Unlike the prior art, much more refrigerant moves through the system than is evaporated in the evaporator. The major proportion of refrigerant through the evaporator remains liquid. The rate of liquid injection into the evaporator might be twice, or twenty times, the rate of evaporation in the evaporator, depending on the application.

The injector nozzle 16 conveys refrigerant in the primary refrigerant path from the pressure port of the nozzle in line 42 to its discharge port in line 43. This action of "motive fluid" in the primary path generates suction at the suction port of the injector nozzle to thereby draw low pressure liquid refrigerant from the LP liquid line 47 and separator 20, and carry it into the LP liquid line 43 and into the evaporator 18 along with the motive fluid.

The secondary HP vapor line 46 which connects the primary HP vapor line 41 to the LP liquid line 43, by-passing the condenser 14 and injector nozzle 16, includes a temperature responsive on-off control valve 30 by which to open and close the HP vapor line 46. Control valve 30 is responsive to product (e.g. milk) temperature in the product conduits or tubes 22 immediately downstream of the evaporator 18 by means of a thermocouple or like temperature sensor 32, and is set to open at a low product temperature (e.g. 29° F.) and to close at a high product temperature (e.g. 32° F.). When product leaving the evaporator reaches the low temperature limit (29° F.), the control valve 30 opens to admit a quantity of high pressure hot refrigerant vapor directly into line 43 and evaporator 18, bypassing the condenser 14 and nozzle 16 and injecting heat directly into the evaporator. Conversely, when product fluid leaving the evaporator reaches the high temperature limit (32° F.), the control valve 30 closes and the refrigerant once again moves only in its primary path through the condenser 14, nozzle 16, and so on until product temperature once again reaches its lower limit and calls for the injection of heat to prevent freezing.

Overfeeding the evaporator with liquid refrigerant serves two special purposes: First, most of the refrigerant passing through the evaporator does not evaporate. The major proportion remains liquid, therefore continually absorbing latent heat of vaporization, not sensible heat, at a constant phase transition temperature within the evaporator. In this way, the refrigerant and the evaporation chamber are kept at the lowest possible temperature, which is both constant and uniform from end to end in the evaporator. This permits product flow in either direction through the evaporator. Second, the refrigerant liquid/vapor emulsion and its high rate of flow within the evaporator create an agitation or turbulence of the medium preventing boundary layers and thermal gradients from forming on heat exchange surfaces, continually maintaining these as "prime surfaces".

The foregoing description of a preferred embodiment of this invention is intended as illustrative. The concept and scope of the invention are limited only by the following claims and equivalents thereof.

What is claimed is:

1. A refrigeration system including a compressor, a condenser, an injector nozzle, an evaporator, and a refrigerant separator operatively connected in series in a primary refrigerant path;

said compressor effective to receive refrigerant vapor from said separator and to discharge the same under pressure to said condenser;

said condenser effective to partially condense said refrigerant vapor to a wet vapor;

said injector nozzle including a discharge port operatively connected to said evaporator, and a suction port operatively connected to said refrigerant separator, said nozzle effective to further condense said wet vapor, to draw liquid refrigerant from said separator, and to discharge liquid refrigerant to said evaporator;

said evaporator including an evaporation chamber and a product fluid conduit extending therethrough, said evaporator effective to evaporate a portion of said liquid refrigerant;

said refrigerant separator adapted to receive refrigerant from said evaporator and to separate liquid from vapor therein.

2. A refrigeration system as defined in claim 1, further including:

a secondary refrigerant line from downstream of said compressor to downstream of said injector nozzle, by-passing said condenser and said injector nozzle; and a shut off valve responsive to the temperature of product fluid in said product fluid conduit downstream of said evaporator to open said secondary line when said temperature reaches a preestablished lower limit and to close said secondary line when said temperature reaches a preestablished upper limit.

3. A refrigeration cycle including the following process steps:

(a) compression of a refrigerant in a compressor;

(b) partial condensation of said refrigerant to a wet vapor in a condenser;

(c) further condensation of said wet vapor in an injector nozzle to generate suction and to discharge liquid refrigerant to an evaporator;

(d) partial evaporation of said liquid refrigerant at constant temperature in an evaporator;

(e) separation of liquid and vapor from said evaporator in a refrigerant separator;

(f) suction of said liquid from said separator into said injector nozzle; and (g) suction of said vapor from said separator into said compressor.

4. A refrigeration cycle as defined in claim 3, further including the following process steps:

(h) injecting compressed refrigerant into said evaporator, by-passing said condenser and said injector nozzle, in response to temperature of product fluid downstream of said evaporator when said temperature reaches a preestablished lower limit; and (i) negating step (h) when said temperature reaches a preestablished upper limit.

5. A refrigeration cycle including the following process steps:

(a) compression of a refrigerant in a compressor at a compression rate;

(b) partial condensation of said refrigerant to a wet vapor in a condenser at a condensation rate less than said compression rate;

(c) further condensation of said wet vapor in an injector nozzle to generate suction and to discharge liquid refrigerant to an evaporator at an injection rate;

(d) partial evaporation of said liquid refrigerant at constant temperature in said evaporator at an evaporation rate less than said injection rate;

(e) separation of liquid and vapor from said evaporator in a refrigerant separator;

(f) suction of said liquid from said separator into said injector nozzle; and (g) suction of said vapor from said separator into said compressor.

6. A refrigeration cycle as defined in claim 5 in which said injection rate is more than twice said evaporation rate.

7. A refrigeration cycle as defined in claim 5 in which the ratio of said injection rate to said evaporation rate is between 2:1 and 20:1.

8. A refrigeration cycle including the following process steps:

(a) introduction of liquid refrigerant to an evaporator at an injection rate;

(b) partial evaporation of said liquid refrigerant at constant temperature in said evaporator at an evaporation rate less than said injection rate;

said partial evaporation effective to produce a turbulent refrigerant liquid/vapor emulsion in said evaporator to thereby prevent the formation of boundary layers and thermal gradients on heat exchange surfaces and to continually maintain prime surfaces thereon.

9. A refrigeration cycle including the following process steps:

(a) compression of a refrigerant in a compressor at a compression rate;

(b) partial condensation of said refrigerant to a wet vapor in a condenser at a condensation rate less than said compression rate;

(c) further condensation of said wet vapor in an injector nozzle to generate suction and to discharge liquid refrigerant to an evaporator at an injection rate;

(d) partial evaporation of said liquid refrigerant at constant temperature in said evaporator at an evaporation rate less than said injection rate to produce a turbulent refrigerant liquid/vapor emulsion in said evaporator to thereby prevent the formation of boundary layers and thermal gradients on heat exchange surfaces and to continually maintain prime surfaces thereon;

(e) separation of liquid and vapor from said evaporator in a refrigerant separator;

(f) suction of said liquid from said separator into said injector nozzle; and (g) suction of said vapor from said separator into said compressor.

* * * * *